US005176572A

United States Patent [19]

Kennedy

[11] Patent Number: 5,176,572

[45] Date of Patent: Jan. 5, 1993

[54] ASSEMBLY AND METHOD FOR CONTROL AND REMOVAL OF PARTICULATE CONTAMINATION

[75] Inventor: Robert A. Kennedy, Brick Town, N.J.

[73] Assignee: Unique Systems of America, Inc., Avenel, N.J.

[21] Appl. No.: 739,312

[22] Filed: Aug. 1, 1991

[51] Int. Cl.[5] ..... F24F 7/00

[52] U.S. Cl. ..... 454/341; 55/385.2; 454/49

[58] Field of Search ..... 454/49, 340, 341; 98/42.02; 55/385.2

[56] References Cited

U.S. PATENT DOCUMENTS

| | | | |
|---|---|---|---|
| 4,164,901 | 8/1979 | Everett | 55/385.2 X |
| 4,801,312 | 1/1989 | Mateson | 454/49 X |
| 4,856,419 | 8/1989 | Imai | 454/49 |
| 4,928,581 | 5/1990 | Jacobson | 454/49 X |
| 5,009,685 | 4/1991 | Wilson et al. | 454/49 X |
| 5,088,511 | 2/1992 | Bain | 55/385.2 X |
| 5,090,972 | 2/1992 | Eller et al. | 454/49 X |

*Primary Examiner*—William E. Tapolcai
*Attorney, Agent, or Firm*—Clifford G. Frayne

[57] ABSTRACT

A method and apparatus for the prevention of migration of hazardous particulate matter from a negative pressure environment established within a building in order to collect and dispose of the hazardous particulate matter, the apparatus and method for the prevention of migration of a hazardous particulate matter from the area being cleaned including an enclosed passageway positioned parallel of the temporary wall means established so as to define the area to be cleaned, the enclosed passageway being continuously evacuated so as to establish a negative pressure in the enclosed passageway which is greater than the negative pressure in the area being cleaned in order to ensure any hazardous particulate matter escaping from the area being cleaned is captured in the enclosed passageway and removed before migrating to other areas of the building in which normal activities are in progress.

5 Claims, 3 Drawing Sheets

ASSEMBLY AND METHOD FOR CONTROL AND REMOVAL OF PARTICULATE CONTAMINATION

FIELD OF INVENTION

This invention relates to the collection and removal of particulate contamination, and in particular, hazardous contamination such as asbestos fibers, from large, enclosed areas, in which the collection and removal must be performed in sequence in less than the entire desired area.

BACKGROUND OF THE INVENTION

The breathing of particulate matter presents a myriad of potential health problems. The breathing of hazardous or contaminated particulate matter exacerbates these problems. It has been recognized that asbestos fibers, long utilized in the construction industry, presents certain health dangers and in recent years, massive projects have been commenced to remove asbestos insulation, asbestos ceilings and the like from buildings, ships and other facilities where it was utilized in the construction.

The removal of asbestos fibers is subject to various Federal and State regulations regarding the segregation of the area in which the work is to be performed, the collection, removal and disposal of the asbestos fibers. It is preferable when performing the collection and removal of this particulate contamination that the entire enclosed area, such as a room or floor of a building, or a warehouse, be isolated from the ambient atmosphere. Protective coverings normally consisting of multi-layers of polyethylene film are secured to the interior of the walls and airlocks are utilized for individuals operating the removal apparatus with respect to the ingress and egress from the enclosed area.

Normally, the asbestos is collected and large pieces are ground up to a more desirable size for disposal with the entire amount of asbestos being collected under negative pressure or vacuum pressure into a container which meets the Federal and State regulation guidelines.

It is oftentimes required to maintain the interior of the room or floor which is being decontaminated, under negative pressure to prevent the egress of asbestos fibers into the ambient, surrounding atmosphere. This negative pressure would work in conjunction with the interior lining of the walls to prevent this escape of asbestos fibers. Attention has been given to providing a protective area for the cleaning of asbestos fibers and preventing their migration to the ambient atmosphere (see U.S. Pat. No. 4,604,111 to Natale).

Oftentimes, it is necessary to decontaminate large areas while at the same time permitting normal operations to occur in these areas. In such instances, these areas are divided in an appropriate manner with a temporary wall erected from floor to ceiling, this wall having secured thereon, the appropriate layers of protective material, such as layers of polyethylene. Thus, particulate contamination removal can occur on one side of the wall while simultaneously, normal business activities are conducted on the opposing side of the wall. Upon completion and decontamination of one area, the normal business activities would be transferred to the decontaminated portion of the room or floor and cleaning would commence on the opposing contaminated portion of the room.

The walls constructed for the aforesaid decontamination process may be of solid material such as a frame with plywood having polyethylene secured thereto or merely just a frame having multi-layers of polyethylene secured thereto. Nevertheless, the need to decontaminate a room by this method is less desirable than having the total evacuation of the room or floor. Therefore, in order to provide additional assurance that there will be to migration of asbestos fibers from the area being decontaminated to the area in which normal business activities are being conducted and to provide a degree of assurance and safety to those individuals conducting the normal business activities while decontamination occurs immediately adjacent them, the Applicant has developed a double wall system which provides an additional barrier to the migration of asbestos fibers, the design of which would have application to the sequential cleaning and decontamination of large areas as discussed, or to the cleaning and decontamination of smaller areas.

SUMMARY OF THE INVENTION

A method and apparatus for protecting individuals from airborne particulate matter, and in particular, hazardous airborne particulate matter in a situation in which a portion of a particular area is subjected to removal of the hazardous particulate waste while an adjacent portion of the particular area is utilized for normal activities. The area to be decontaminated is typically segregated from the normal activity area by a partition constructed and layered with polyethylene or the like, the area being decontaminated maintained under negative pressure relative to the ambient atmosphere. A puncture of the partition or loss of negative pressure might result in particulate hazardous waste migrating to the area being normally utilized. Applicant's assembly and method establishes a second partition in the form of a barrier wall adjacent the temporary partition on the normally-utilized side of the temporary partition, Applicant's barrier wall defining a channel through which air is drawn so as to establish a negative pressure greater than that in the work area so as to ensure that any migration of hazardous particulate waste through the temporary partition would be immediately evacuated from Applicant's barrier wall as opposed to migrating to the area being utilized for normal activities.

OBJECTS OF THE INVENTION

An object of the present invention is to provide for a novel assembly and method of containing, lowering and eliminating the danger of airborne hazardous particulate waste inhalation by individuals working in a building in which hazardous particulate waste are being removed.

It is a further object of the present invention to provide for a novel assembly and method to prevent the migration of hazardous particulate waste from the area in which it is being generated and cleaned, to the ambient atmosphere.

A further object of the present invention is to provide a novel assembly and method to ensure that if negative pressure in the work area which is being cleaned is lost, the particulate hazardous waste will not migrate to immediate adjacent areas in which normal activities are occurring.

It is a further object of the present invention to provide for a novel assembly and method which provides additional protection to workers not associated with the cleanup of the hazardous particulate waste, but which work in close proximity thereto.

BRIEF DESCRIPTION OF THE DRAWINGS

These and other objects of the present invention will become apparent, particularly when taken with respect to the following illustrations in which.

DETAILED DESCRIPTION OF THE DRAWINGS

Figure 1:
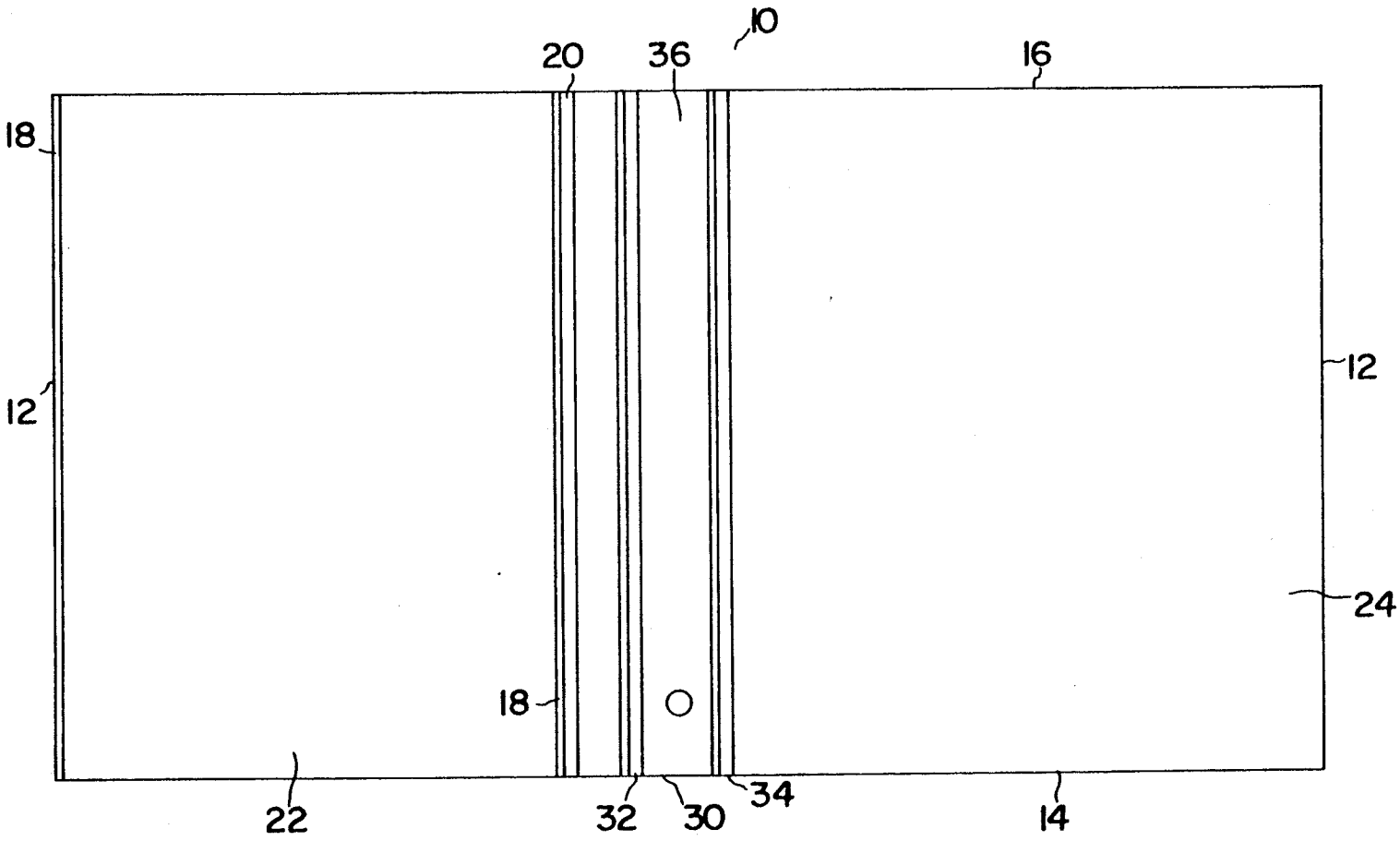
FIG. 1 is an end view of a typical area in which hazardous particulate waste is being removed, illustrating an embodiment of Applicant's negative pressure barrier wall.

Referring to FIG. 1, there is illustrated an end view of a typical work area 10 which has been contaminated by particulate hazardous matter and in particular, asbestos fibers. Such a contaminated work area would normally be defined by sidewalls 12, floor 14, and a ceiling 16. The preferable manner of removing the particulate hazardous waste from such an area would be to completely segregate the area from the ambient atmosphere. In most situations, the hazardous waste or asbestos is normally associated with the ceiling, or with insulation around pipes positioned proximate to the ceiling. Normal procedure would be to line the interior walls of the area with multiple layers of impermeable plastic 18 such as polyethylene or the like. A negative pressure would be drawn on the interior and workmen wearing protective suits and breathing apparatus would remove the asbestos and transfer the asbestos via conduits to a collection device. The area would be vacuumed and washed and the multiple layers of polyethylene would similarly be washed and disposed of after the removal process In some instances, it is not possible to completely segregate the entire area from the ambient atmosphere in that normal business functions or social functions must be permitted to continue in at least a portion of the area. In these circumstances, a temporary barrier wall 20 is normally erected by the contractor. Barrier wall 20 extends from floor to ceiling and can consist of a solid plywood or sheetrock wall or a frame wall. In either instance, this wall is covered with several layers of an impermeable plastic 18 such as polyethylene on the interior side of the area to be decontaminated.

In this situation, workers removing the particulate hazardous waste work within the removal area 22 while normal business activities are conducted in the remainder of the area 24. A negative pressure is drawn on work area 22 identically as if the entire area were being subjected to decontamination. Once work area 22 had been cleared of asbestos and vacuumed and washed down, the polyethylene film surrounding the sidewalls and temporary barrier 20 would be removed. Normal business activities would resume in this area while the prior business work area 24 would be lined with impermeable plastic and decontaminated.

Certain concern and anxiety arise when decontamination must be conducted under these conditions. Additional assurances and safety features are required to protect the individuals working in the normal business area. Therefore, Applicant proposes a secondary barrier wall 30 positioned adjacent temporary barrier 20 in the normal work area 24, the second barrier wall defining a self-encased space under greater negative pressure than the area to be decontaminated.

Secondary barrier wall 30 is comprised of two opposing walls 32 and 34 which are in sealing contact with the floor and the ceiling 14 and 16, respectively. Walls 32 and 34 are spaced apart thus defining a passageway 36 which is parallel to the temporary barrier wall 20. Second barrier wall 30 is also in sealing contact with opposing sidewalls 12.

Figure 2:
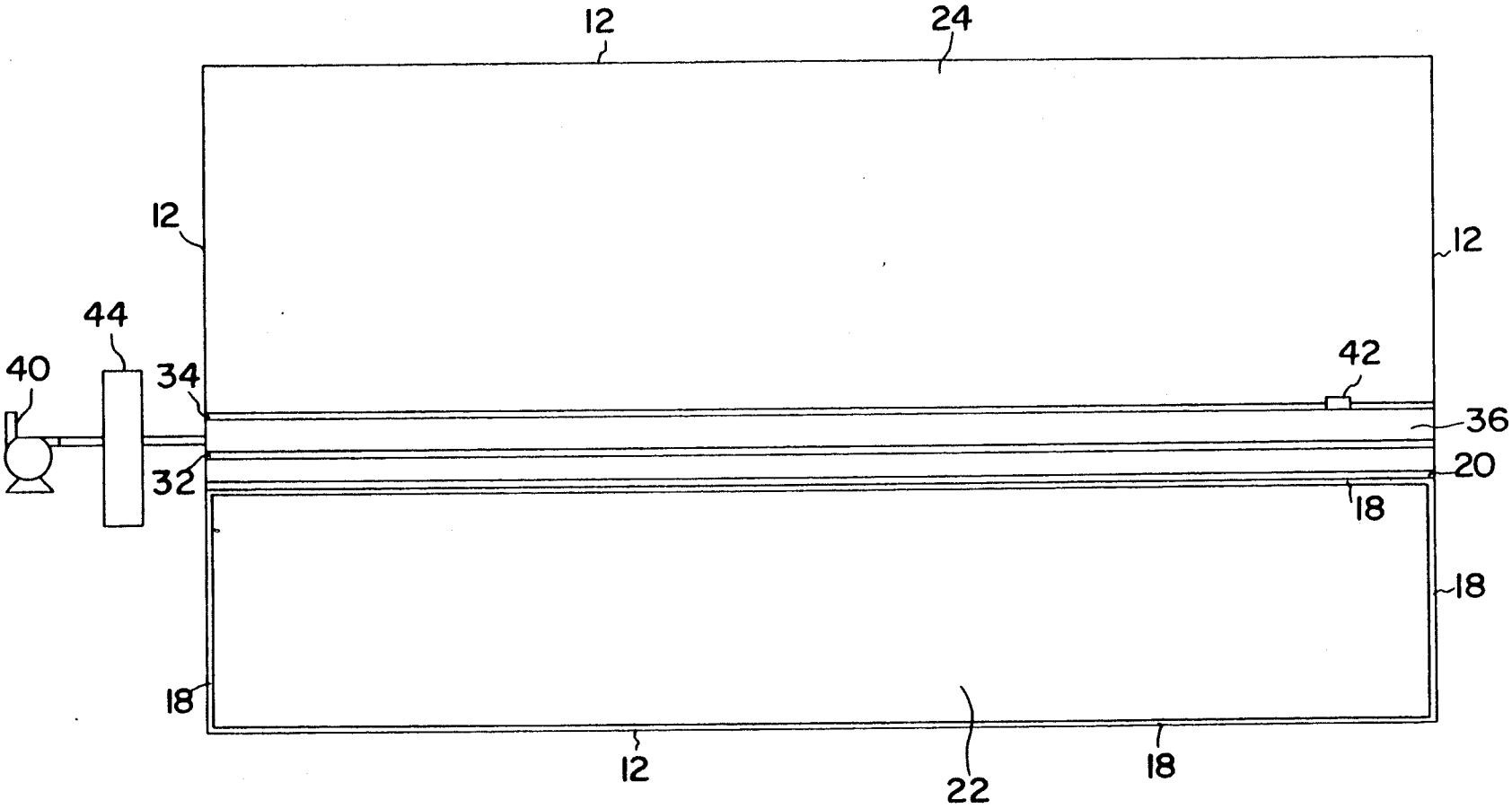
FIG. 2 is a top view of an area in which particulate hazardous waste is being removed illustrating a first embodiment of Applicant's negative pressure wall.

FIG. 2 is a top plan view of the proposed work area illustrating a temporary barrier 20 and secondary barrier 30. Passageway 36 in secondary barrier wall 30 is in communication with a blower or vacuum pump 40. Secondary barrier wall 30 also has a vent 42 at the opposing end of passageway 36 from blower or vacuum pump 40. Vent 42 is illustrated in FIG. 2, communicates with the business work area. Yent 42 would be of a hinged flap nature such that it would swing inwardly into passageway 36 to permit the passage of air from the business work area into passageway 36.

In this configuration, removal area 22 would be secured to a second blower or vacuum means creating a negative pressure of approximately 0.02 inches of water. Blower or vacuum means 40 evacuating air through passageway 36 would maintain a negative pressure in passageway 36 of approximately 0.04 inches of water. Therefore, any possible migration of hazardous particulate waste from the removal area 22 through temporary barrier wall 20 would encounter second barrier wall 30 and the negative pressure maintained within passageway 36 such that any particulate matter would be drawn outwardly by means of blower 40 into a collection unit 44.

As an example, if passageway 36 were approximately six inches wide, the evacuation of 4400 cubic feet per minute would result in the desired negative pressure with an airflow of approximately 3.9 miles per hour which would not create any discomfort or hazard to the individuals working in the business area.

This embodiment of the negative pressure wall could be erected from common construction materials and at the end of its required usefulness, cleaned in the nature that the work area is cleaned and then disposed of in accordance with hazardous particulate waste regulations.

Figure 3:
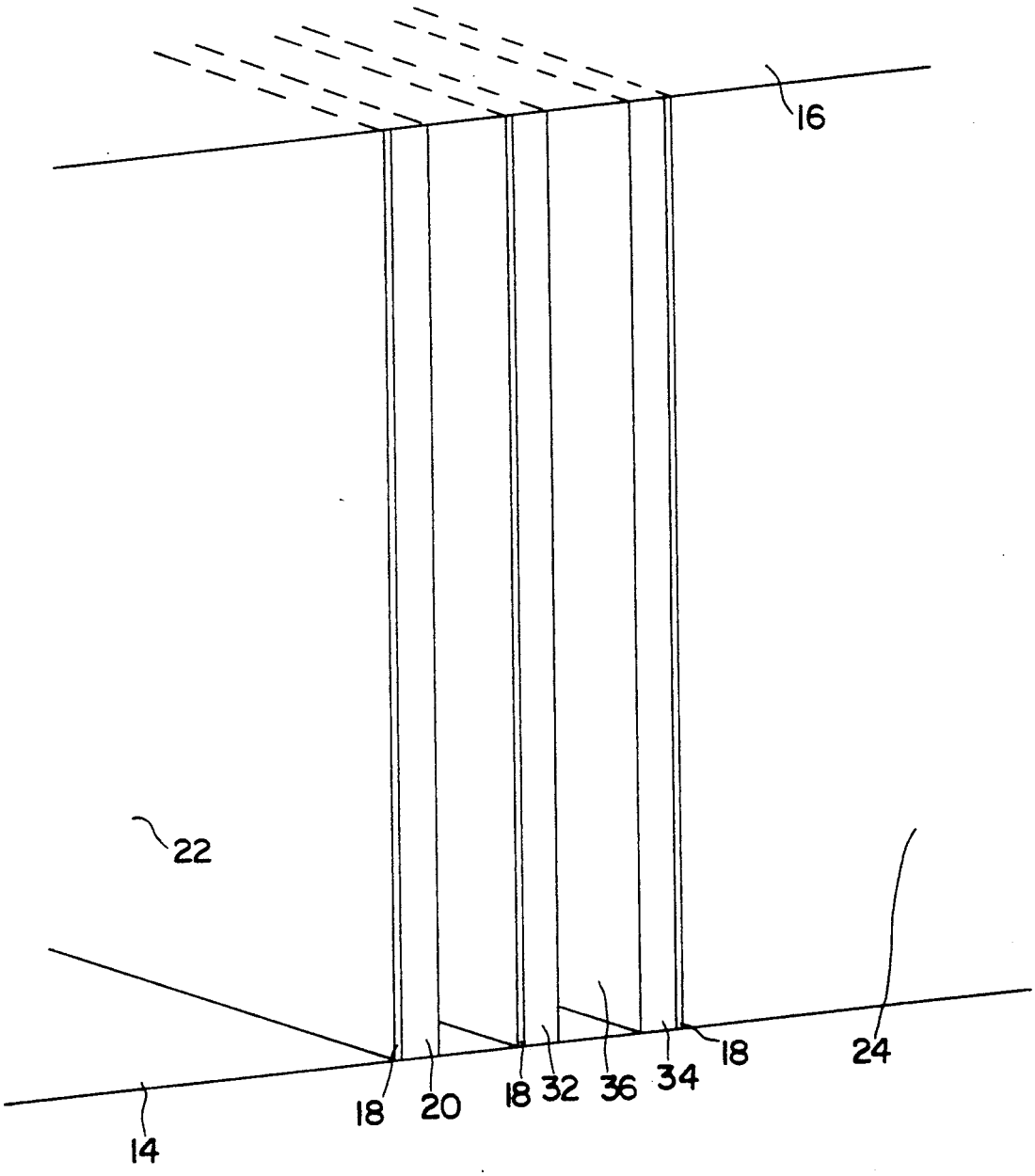
FIG. 3 is a partial cutaway view of a negative pressure wall.

FIG. 3 is a partial cutaway perspective view showing the relationship of secondary barrier wall 30 in relationship to the area in which the hazardous material is being removed and the area in which normal business activities are being conducted.

While the present invention has been described in connection with the exemplary embodiment thereof, it will be apparent to those of ordinary skill in the art that this application is intended to cover any adaptations or variations thereof. Therefore, it is manifestly intended that the invention be only limited by the claims and the equivalents thereof.

I claim:

1. An apparatus for the prevention of migration of hazardous particulate matter from a negative pressure environment established within an existing building, said negative pressure environment defined as an enclosed space within said building defined by the existing wall structure of said building and temporary wall means, said negative pressure environment having a means for introduction of an airflow path and a means for continuous evacuation of air from said negative pressure environment, said method for prevention of migration of hazardous particulate matter comprising:

an enclosed passageway positioned parallel to said temporary wall means, said enclosed passageway having a means for the introduction of air into said enclosed passageway and a means for the continuous evacuation of air from said enclosed passageway, said enclosed passageway having an impermeable wall covering, said evacuation of said air from said enclosed space being of such a volume so as to create a negative pressure in said enclosed passageway greater than the negative of said negative pressure environment.

2. An apparatus in accordance with claim 1 wherein said enclosed passageway is defined by opposing wall members in sealing contact with the floor, ceiling and end walls of said building.

3. An apparatus in accordance with claim 1 wherein said means for introduction of said air into said enclosed passageway comprises a vent means communicating said enclosed passageway with said ambient atmosphere.

4. An apparatus in accordance with claim 1 wherein said means for the continuous evacuation of air from said enclosed passageway comprises a blower in communication with a collection chamber for the collection of particulate matter evacuated from said enclosed passageway, said blower establishing a negative pressure in said enclosed passageway greater than said negative pressure in said negative pressure environment.

5. A method for the prevention of migration of hazardous particulate matter from a negative pressure environment established within an existing building, the negative pressure environment defined as an enclosed space within said building defined by the existing wall structure of said building and temporary wall means, said negative pressure environment having a means for the introduction of an airflow path and the means for the continuous evacuation of air from said negative pressure environment in order to contain said hazardous particulate matter, said method for the prevention of migration of said hazardous particulate matter comprising:

establishing a secondary wall means parallel to said temporary wall means, said secondary wall means comprising two parallel walls and ceiling contact with the floor, ceiling and end walls of said existing building, said secondary wall means defining an enclosed passageway therebetween;

covering said exterior walls of said secondary wall means with an impermeable material;

providing a venting means from the ambient atmosphere to said enclosed passageway;

communicating said passageway with a collection means and a blower means for the evacuation of air from said enclosed passageway;

establishing an airflow rate sufficient to establish a greater negative pressure in said enclosed passageway than in said negative pressure environment.

* * * * *